United States Patent [19]

Kawamura et al.

[11] 4,253,441

[45] Mar. 3, 1981

[54] FUEL SUPPLY SYSTEM FOR MULTI-CYLINDER ENGINE EQUIPPED WITH FUEL INJECTOR

[75] Inventors: Yoshihisa Kawamura, Fujisawa; Mitsumasa Inoue, Yokohama; Masaaki Saito, Yokosuka, all of Japan

[73] Assignee: Nissan Motor Company, Limited, Yokohama, Japan

[21] Appl. No.: 18,006

[22] Filed: Mar. 7, 1979

[30] Foreign Application Priority Data

Mar. 22, 1978 [JP] Japan ..... 53/31673

[51] Int. Cl.[3] ..... F02B 3/00

[52] U.S. Cl. ..... 123/445

[58] Field of Search ..... 123/32 EA, 139 AW, 141, 123/122 AC, 119 R, 131

[56] References Cited

U.S. PATENT DOCUMENTS

| | | | |
|---|---|---|---|
| 862,856 | 8/1907 | Iygard | 123/141 |
| 3,461,850 | 8/1969 | Oblander | 123/139 AW |
| 4,015,575 | 4/1977 | Fox | 123/141 |
| 4,022,176 | 5/1977 | Taylor | 123/141 |
| 4,024,849 | 5/1977 | Hoods | 123/141 |
| 4,099,504 | 7/1978 | Bickhaus | 123/122 AC |
| 4,167,158 | 9/1979 | Martin et al. | 123/32 EA |
| 4,175,528 | 11/1979 | Mennesson | 123/139 AW |

*Primary Examiner*—Charles J. Myhre
*Assistant Examiner*—Raymond A. Nelli
*Attorney, Agent, or Firm*—Schwartz, Jeffery, Schwaab, Mack, Blumenthal & Koch

[57] ABSTRACT

A fuel supply system for a multi-cylinder internal combustion engine, comprises an intake passageway which is provided therein with a throttle valve, a fuel injector whose nozzle is located in the intake passageway downstream of the throttle valve, and a fuel reflector against which at least a part of the fuel injected from the fuel injector strikes to be reflected, the fuel reflector being located opposite to the nozzle tip of said fuel injector, so that fuel distribution to a plurality of engine cylinders can be uniformalized.

6 Claims, 12 Drawing Figures

FUEL SUPPLY SYSTEM FOR MULTI-CYLINDER ENGINE EQUIPPED WITH FUEL INJECTOR

This invention relates in general to a fuel supply system for use in a multi-cylinder internal combustion engine, and more particularly to an improvement in a single point fuel injection system in which at least one fuel injector is disposed in an intake passageway upstream of the riser portion of an intake manifold to inject fuel to be distributed into a plurality of engine cylinders.

It is the prime object of the present invention to provide an improved fuel injection system for a multi-cylinder internal combustion engine, by which high engine performance can be maintained throughout various engine operating ranges, improving the emission control of the engine.

Another object of the present invention is to provide an improved fuel injection system for a multi-cylinder internal combustion engine, by which uniform air-fuel mixture can be supplied to a plurality of engine cylinders, respectively.

A still another object of the present invention is to provide an improved fuel supply system for a multi-cylinder internal combustion engine, which can improve uniform distribution of the fuel injected from a fuel injector into a plurality of engine cylinders.

A further object of the present invention is to provide an improved fuel supply system for a multi-cylinder internal combustion engine, by which the atomization of the fuel injection from a fuel injector can be improved, uniformalizing the amount of fuel to be adhered on the inner wall surface of an intake passageway.

A still further object of the present invention is to provide an improved fuel supply system of a multi-cylinder internal combustion engine, which is provided with a fuel reflector against which the fuel injected from a fuel injector strikes to be reflected, the fuel reflector being disposed in an intake passageway between a throttle valve and the riser portion of an intake manifold.

Other objects, features, and advantages of the fuel supply system according to the present invention will become more apparent from the following description taken in conjunction with the accompanying drawings in which like reference numerals are assigned to like parts and elements throughout all figures, in which.

In a single point fuel injection system wherein fuel is injected from at least one fuel injector into an intake passageway upstream of the riser portion of an intake manifold, uniform distribution of injected fuel into each of a plurality of engine cylinders has been eagerly desired. This is because the single fuel injection system is essentially different from a fuel injection system wherein a plurality of fuel injectors are disposed immediately upstream of engine cylinders, respectively, so that each fuel injector is arranged to supply fuel into each engine cylinder.

Of the single point fuel injection systems, there is one constructed such that a fuel injector is located at a side of the inner wall surface of the intake passageway toward the opposite side of the inner wall surface. Such constructed single point fuel injection system has encountered the following problems: a considerable part of the injected fuel unavoidably adheres on the inner wall surface of the intake passageway. Then, the adhered fuel becomes a liquid fuel stream flowing on the inner wall surface of the intake passageway and thereafter the fuel stream is introduced into the engine cylinders. However, it is difficult to maintain a linear stream of intake air flow in the intake passageway, and therefore the intake air flow is liable to become a rotational stream. By the action of such a rotational stream of the intake air, the above-mentioned fuel stream on the intake passageway inner wall surface and then flows concentrically into the inlet portion of certain intake manifold branch runners in accordance with the direction of the above-mentioned rotational stream of the intake air, the inlet portion being located most adjacent to a portion of the inner wall surface of the intake passageway on which the fuel injected from the injector adheres. As a result, the engine cylinders connected to the certain branch runners are supplied with air-fuel mixtures richer than a predetermined level, and accordingly the remaining engine cylinders are necessarily supplied with air-fuel mixtures leaner than the predetermined level.

Figure 1A:
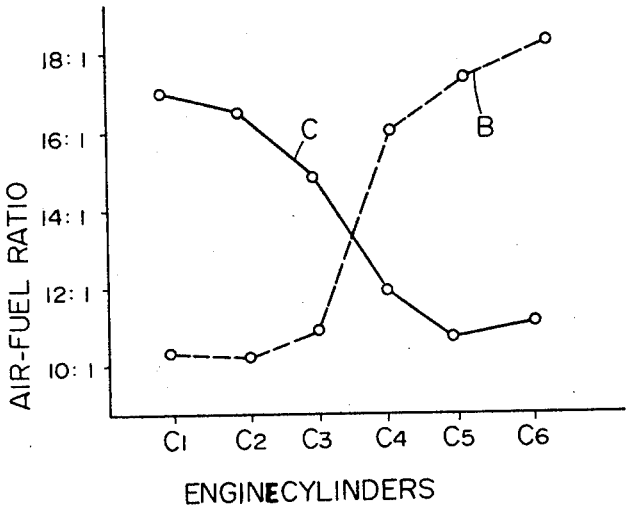
FIG. 1A is a graph showing the variation of the air-fuel ratios of the mixtures supplied to six-cylinders, respectively, in cases of engines which will be shown in FIGS. 1B and 1C mentioned after.
Figure 1B:
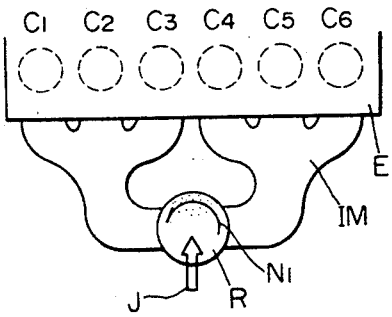
FIG. 1B is a schematic plan view of a conventional multi-cylinder internal combustion engine.
Figure 1C:
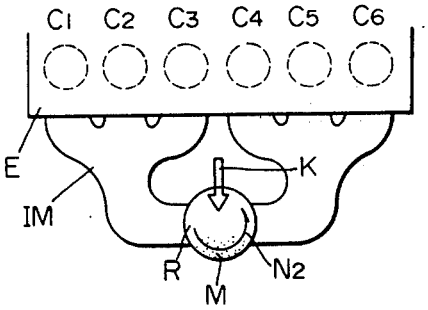
FIG. 1C is a schematic plan view of another conventional multi-cylinder internal combustion engine.

Such phenomena were experimentally proved as shown at the graph in FIG. 1A in which a broken curve B indicates the air-fuel ratios of the mixtures supplied to six cylinders $C_1$ to $C_6$ in case of an engine in FIG. 1B, and a solid curve C indicates the air-fuel ratios of the mixtures supplied to the six cylinders $C_1$ to $C_6$ in case of an engine in FIG. 1C. In the engine shown in FIG. 1B, intake air rotated in the direction of an arrow $N_1$ in an intake passageway, and the fuel was injected in the direction of an arrow J so that the injected fuel adhered on a portion L of the inner wall surface of the intake passageway. In the engine shown in FIG. 1C, the intake air rotated in the direction of an arrow $N_2$ in an intake passageway R, and the fuel was injected in the direction of an arrow K so that the injected fuel adhered on a portion M of the inner wall surface of the intake passageway. In FIGS. 1B and 1C, the reference characters E and IM denote an engine and an intake manifold, respectively. The graph in FIG. 1A was obtained by experiments conducted with engine speed of 1600 rpm and at full throttle. As seen from the graph of FIG. 1A, the distribution of sprayed fuel was not uniform and accordingly uniform air-fuel mixtures could not be supplied into the engine cylinders in engine arranged as in FIGS. 1B and 1C.

In general, in an engine equipped with a fuel injector, the fuel injection amount is controlled in accordance with intake air amount and oxygen concentration in exhaust gases, etc. for the purpose of emission control and improving engine performance. In this regard, uniform distribution of the injected fuel as shown in FIG. 1A is not suitable for such purposes. Such an uniform distribution is particularly phenomenal at high load engine operating range, because the flow speed of the intake air is relatively low at a portion of the intake passageway adjacent the throttle valve. This invites decrease in engine power output and deterioration in driveability. Additionally, an improved uniform distribution of the injected fuel is eagerly desired at low load engine operating range in which the amount of the intake air is relatively small.

In view of the above, the present invention contemplates to avoid the problems encountered in a conventional fuel supply system for a multi-cylinder internal combustion engine, by providing a fuel reflector in the intake passageway between a throttle valve and the riser portion of an intake manifold and located opposite to the nozzle of a fuel injector in order that the fuel injected from the injector nozzle is reflected on the surface of the reflector to achieve the uniform distribution of the injected fuel into a plurality of engine cylinders.

Figure 2:
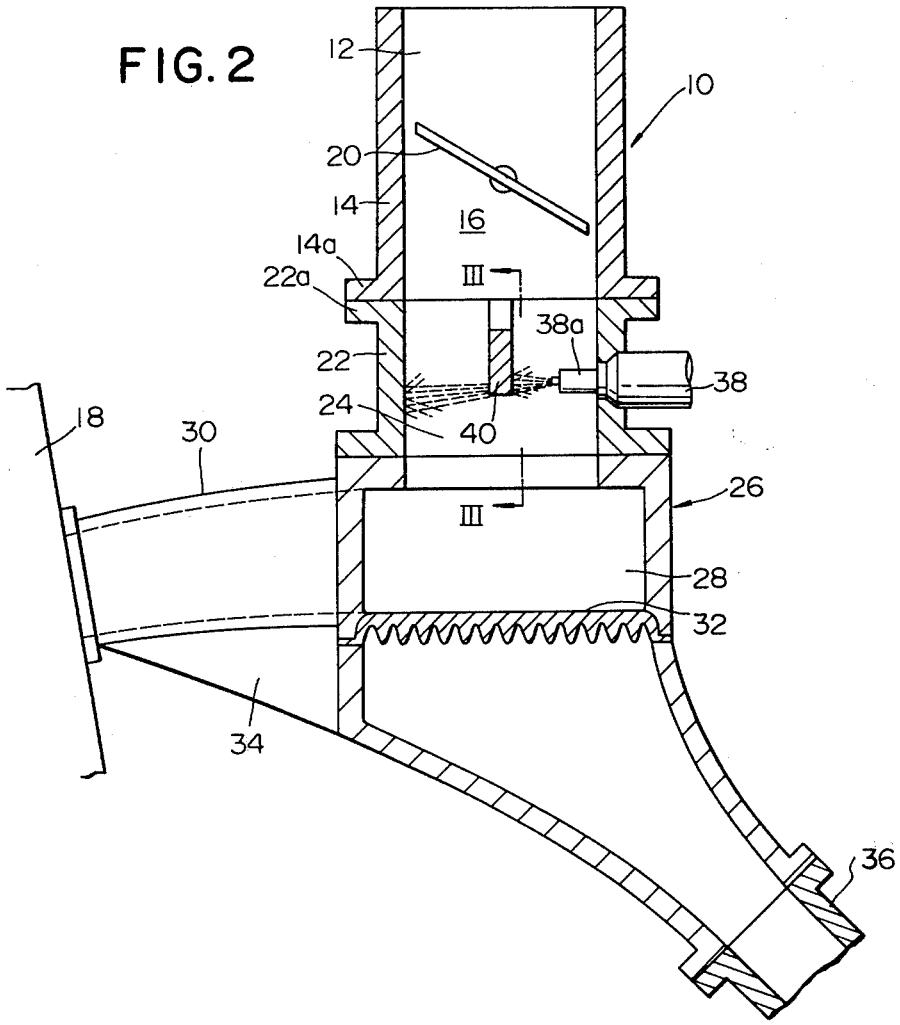
FIG. 2 is a vertical sectional view of a first preferred embodiment of a fuel supply system for a multi-cylinder internal combustion engine, in accordance with the present invention.

Referring now to FIG. 2 of the drawings, there is shown a first preferred embodiment of a fuel supply system 10 for use in a multi-cylinder internal combustion engine (no numeral), in accordance with the present invention. The fuel supply system 10 is composed of a throttle chamber 12 which is defined by the inner wall surface of a cylindrical member 14. The throttle chamber 12 forms part of an intake passageway 16 through which intake air is inducted or supplied to a plurality of engine cylinders (not shown) combustion chambers formed in a body 18 of the internal combustion engine. A throttle valve 20 is rotatably disposed in the throttle chamber 12 to control the amount of intake air supplied through the intake passageway 16 to the engine cylinders. The throttle chamber 12 is communicated at its top portion with an air flow meter (not shown) which is arranged to sense the flow amount of intake air induced into the engine cylinders. The air flow meter is in turn fluidly connected to an air filter (not shown) to supply purified air into the intake passageway 16. The cylindrical member 14 is securely connected at its bottom flange portion 14*a* with a top flange 22*a* of a cylindrical or barrel member 22 which defines at its inner wall surface an injection chamber 24. Accordingly, the throttle chamber 12 is directly communicated with the injection chamber 24.

An intake manifold 26 is formed with a riser portion 28 at which a plurality of branch runners 30 are gathered. The intake passageway defined in each branch runner 30 is communicable through an intake valve (not shown) with each engine cylinder. As shown, the riser portion 28 is directly communicated with the injection chamber 24. The floor portion 32 or the bottom wall of the riser portion 28 constitutes part of the wall of an exhaust manifold 34. Accordingly, the heat of exhaust gases flowing through the exhaust manifold 34 is transferred to the intake air flowing through the intake manifold 26. In this regard, the floor portion 32 of the riser portion 28 is called a "Hot spot". The exhaust manifold 34 is fluidly connected through an exhaust pipe 36 to a so-called three-way catalytic converter (not shown) which is arranged to oxidize carbon monoxide (CO) and unburned hydrocarbons (HC) and reduce nitrogen oxides (NOx).

A fuel injector or injection valve 38 is securely supported through the wall of the cylindrical member 22 so that the nozzle portion 38*a* is projected into the injection chamber 24. The nozzle 38*a* is, in this case, directed perpendicular to the stream of intake air passing through the injection chamber 24. The fuel injector 38 is electrically connected to a control unit (not shown) which is constructed and arranged to control the valve opening time duration or fuel injection time duration of the fuel injector 38 in accordance with various information signals representing the intake air amount and oxygen ($O_2$) concentration in the exhaust gases, etc. The signal representing the intake air amount is transmitted from the above-mentioned air flow meter, and the signal representing the oxygen concentration is transmitted from an oxygen sensor (not shown) disposed, for example, in the exhaust pipe 36. In this case, the fuel injection amount from the fuel injector 38 is such controlled that the engine cylinders are supplied with stoichiometric air-fuel mixture to effectively work the three-way catalytic converter.

A reflector plate 40 is disposed in the injection chamber 24 and opposite to the tip of the nozzle portion 38*a* of the fuel injector 38 so that at least a part of the fuel injected from the nozzle 38*a* strikes against the plate 40. The plate 40 is such located to lie in a plane (not shown) including the center axis of the barrel member 22. The plate 40 may not be located to lie in the plane including the barrel center axis so that the location of the plate 40 is selectable.

Figure 3:
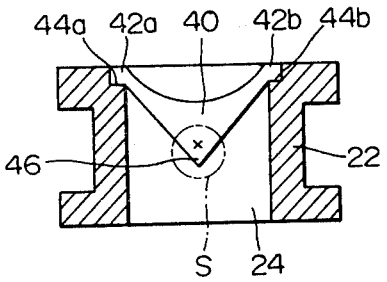
FIG. 3 is a cross-sectional view taken in the direction of arrows substantially along the line III—III in FIG. 2, including an example of a fuel reflector plate.

FIG. 3 shows in detail the reflector plate 40 is generally formed into the shape of isosceles triangle. The plate 40 is formed with two flange portions 42*a* and 42*b* which are securely received in groove 44*a* and 44*b*, respectively, which are formed at the top portion of the cylindrical member 22. Additionally, the flange portions 42*a* and 42*b* are held down by the bottom flange portion 14*a* of the cylinder member 14 so as to securely hold the plate 40 in position. It is to be noted that a shape-pointed portion 46 of the plate 40 corresponding to the apex of the isosceles triangle is directed to be opposed to the riser portion 28 of the intake manifold 26. The sharp-pointed portion 46 of the plate 40 is such located that its apex lies in the center axis of the intake air flowing through the injection chamber 24, and that a part of the cross-sectional range S of the sprayed fuel injected from the injector nozzle 38*a* is occupied with sharp-pointed 46 of the reflector plate 40. It will be understood from the foregoing, that a part of the sprayed fuel injected from the fuel injector 38 strikes against the surface of the reflector plate 40 to be reflected toward the fuel injector nozzle 38*a*, but the remaining part of the sprayed fuel is thrown behind the reflector plate 40. However, all the sprayed fuel from the fuel injector 38 strike against the surface of the reflector plate 40.

Figure 4:
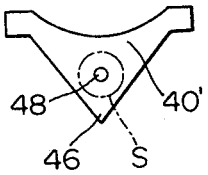
FIG. 4 is a view similar to the fuel reflector plate in FIG. 3, but showing another example.

Otherwise, the reflector plate may be such arranged as shown in FIG. 4, that all the cross-sectional range S of the sprayed fuel from the fuel injector 38 lies within the surface of the reflector plate 40. Additionally, the fuel reflector plate 40' is formed at its central portion with a central opening 48 which passes through the wall of the plate 40'. Also with such an arrangement, a part of the sprayed fuel strikes against the surface of the plate 40' and the remaining part of the sprayed fuel passes the opening 48 to reach behind the plate 40'. It is to be noted that with such an arrangement, the range S of the sprayed fuel is not much varied in accordance with the flow speed of intake air passing through the intake passageway 16, and therefore nearly the same fuel supply condition is maintained throughout all engine operating ranges.

With the arrangement discussed above, a part of sprayed fuel injected from the injector nozzle 38*a* strikes against the surface of the reflector plate 40 or 40' to be reflected toward the nozzle 38*a*. Then, the fuel is effectively atomized and thereafter carried by the rotational stream of the intake air to be well mixed with intake air. Simultaneously, a part of reflected fuel adheres on the inner wall surface of the barrel 22 adjacent the injector nozzle 38*a*. Hence, the sprayed fuel can be effectively prevented from being locally adhered to the barrel inner wall surface which is opposite to the fuel injector nozzle 38*a*. The sprayed fuel adhered to the opposite sides of the inner wall surfaces of the barrel 22 are carried as uniform streams on the inner wall surface of the barrel 22 by the action of the rotational intake air stream. As a result, the fuel stream on the inner wall surface of the barrel 22 is effectively prevented from flowing into particular branch runners. It will be understood that the sprayed fuel which strikes against the barrel inner wall surface opposite to the nozzle 38*a* is also atomized to be effectively mixed with the intake air. As appreciated from the foregoing, the fuel injected from the fuel injector 38 is uniformly distributed into a plurality of the engine cylinders, promoting the atomization of the injected fuel. This can overcome the shortcoming in which fuel stream moving on the inner wall surface of an intake passageway flows into the particular branch runners of the intake manifold.

It is to be noted that, by virtue of the sharp-pointed portion 46 of the reflector plate 40 or 40', liquid fuel droplets can be decreased in their sizes, preventing dropping large size fuel droplets from the reflector plate 40 into the intake passageway 16. In this regard, supplying large fuel droplets causes intermittent enrichment of the air-fuel mixture inducted into the engine cylinders, which inevitably invites unstable running of the engine.

Figure 5A:
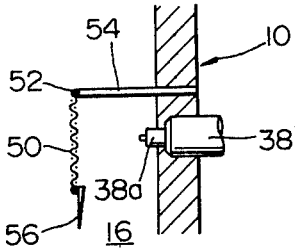
FIG. 5A is a fragmental vertical cross-section of a second preferred embodiment of the fuel supply system for a multi-cylinder internal combustion engine, in accordance with the present invention, including a fuel reflector mesh member.
Figure 5B:
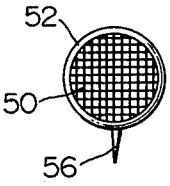
FIG. 5B is a front view of the fuel reflector mesh member in FIG. 5A.

FIGS. 5A and 5B illustrate a second preferred embodiment of the fuel supply system 10 in accordance with the present invention. The fuel supply system 10 is composed of the fuel injector 38 whose nozzle is projected into the injection chamber 24. A fuel reflector mesh member 50 is supported by a ring member 52 and is securely disposed opposite to the tip of the injector nozzle 38*a* so that the sprayed fuel is injected toward the mesh member 50. The ring member 52 is supported by a stay or support rod member 54 which is secured to the wall of the barrel member 22 defining the injection chamber 24. The mesh member 50 of this case is a wire mesh or gauze formed into the shape of lattice, in which the wire diameter is about 0.16 mm and the distance between the adjacent wires is about 0.65 mm. It is to be noted that a short wire needle 56 is secured to the bottom portion of the ring member 52 to prevent dropping large size fuel droplets from the mesh member 50 to the intake passageway 16.

With this arrangement, a part of the sprayed fuel from the fuel injector 38 strikes against the wires of the mesh member 50 and the remaining part of sprayed fuel passes through the openings of the mesh member 50 to go toward the inner wall surface of the barrel member 22. It is to be noted that, since the fuel particles which strikes against the wires are irregularly reflected and therefore further atomization of sprayed fuel can be promoted.

Figure 6A:
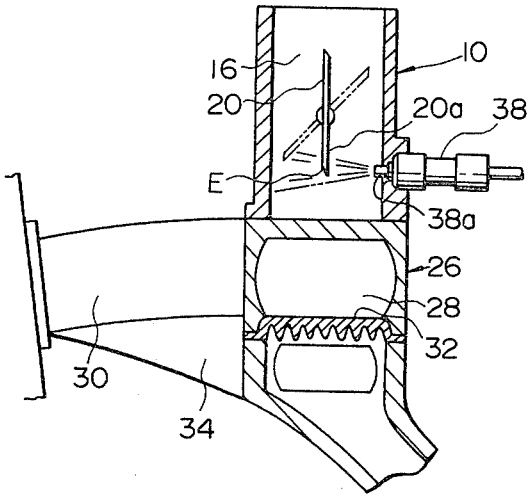
FIG. 6A is a vertical sectional view of a third preferred embodiment of the fuel supply system for a multi-cylinder internal combustion engine, in accordance with the present invention, including a throttle valve whose part serves as a fuel reflector plate.
Figure 6B:
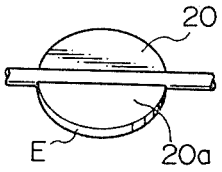
FIG. 6B is a front view of the throttle valve in FIG. 6A.

FIGS. 6A and 6B illustrate a third preferred embodiment of the fuel supply system in accordance with the present invention, in which the throttle valve 20 serves as a reflector plate against which fuel injected from the fuel injector 38 strikes to reflect the injected fuel back toward the nozzle 38*a* of the fuel injector 38. As stated before, the distribution of the injected fuel is particularly deteriorated at the high load engine operating range, i.e., at full throttle as shown in FIG. 6A. In this regard, in this case, the relative location of throttle valve 20 and the fuel injector 38 is such determined that a part of the sprayed fuel injected from the injector nozzle 38*a* strikes against the bottom peripheral portion 20*a* of the throttle valve 20 at full throttle. It is to be noted that the bottom peripheral portion 20*a* of the throttle valve 20 is formed with an edge shaped section E so that relatively large fuel droplets cannot be dropped from the throttle valve 20 into the intake passageway adjacent the riser portion 28 of the intake manifold 26.

Figure 7:
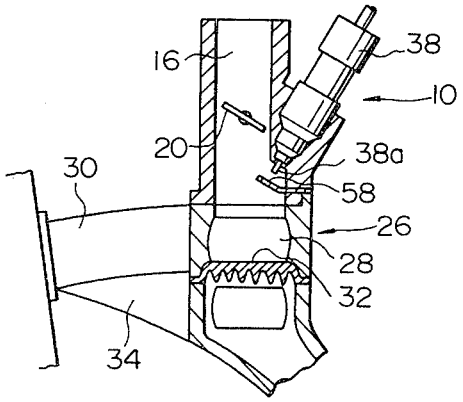
FIG. 7 is a vertical sectional view of a fourth preferred embodiment of the fuel supply system for a multi-cylinder internal combustion engine, in accordance with the present invention.

FIG. 7 illustrates a fourth preferred embodiment of the fuel supply system in accordance with the present invention, in which the nozzle 38*a* of the fuel injector 38 is directed toward the floor portion or hot spot of riser portion 28 of the intake manifold 26. A reflector plate 58 is secured to the wall of the intake passageway 16. The reflector plate 58 is located opposite to the tip of the nozzle 38*a* and such that the center axis of the nozzle 38*a* is perpendicular to the flat surface of the reflector plate 58. Further, the reflector plate 58 is such constructed and arranged that all fuel injected from the fuel injector nozzle 38*a* strikes against the surface of the reflector plate 58.

With the thus arranged fuel supply system, all the sprayed fuel from the fuel injector is reflected on the surface of the reflector plate 58 to promote the atomization of the injected fuel.

Figure 8:
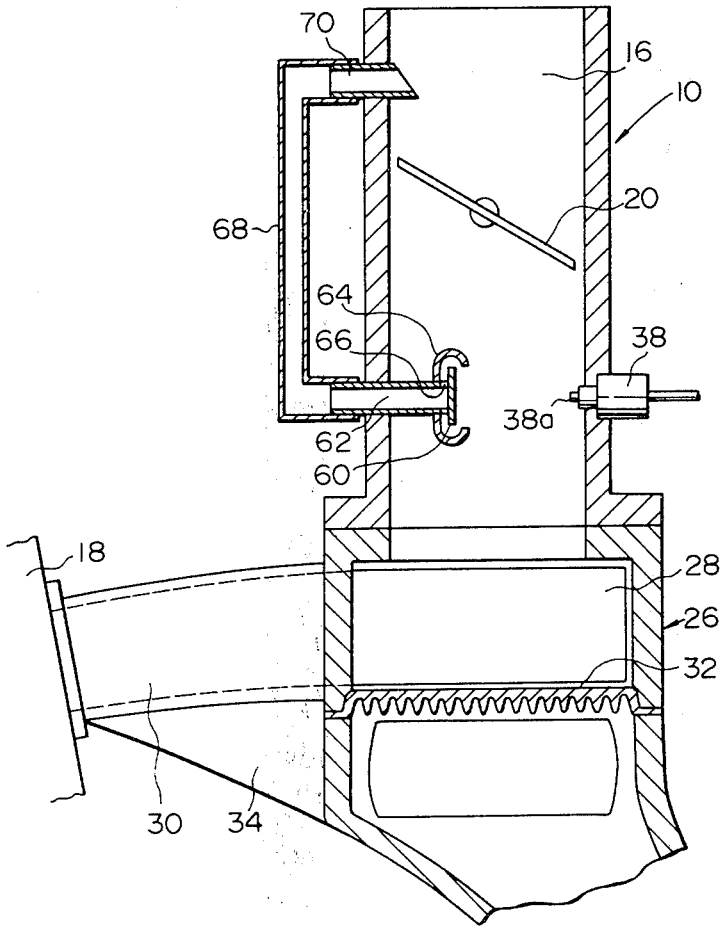
FIG. 8 is a vertical sectional view of a fifth preferred embodiment of the fuel supply system for a multi-cylinder internal combustion engine, in accordance with the present invention.

FIG. 8 illustrates a fifth preferred embodiment of the fuel supply system in accordance with the present invention, in which a fuel reflector 60 is securely disposed in the intake passageway 16 downstream of throttle valve 20 and located opposite to the nozzle 38*a* of the fuel injector 38 so that the extension of the center axis of the nozzle 38*a* is perpendicular to the surface of the reflector plate 60. The reflector plate 60 is secured at the tip of a pipe member 62 which passes through and supported by the wall of the intake passageway 16. An air guide member 64 is secured to the pipe member 62 so as to enclose the peripheral portion of the reflector plate 60. A plurality of openings 66 are formed through the wall of the pipe member 62 which openings 66 are located between the reflector plate 60 and the air guid member 64. The pipe member 62 is fluidly connected through a connecting pipe member 68 to a pipe member 70 which is securely disposed through the wall of the intake passageway 16 upstream of the throttle valve 20.

With this arrangement, all the sprayed fuel injected from the fuel injector 38 strikes against the surface of the reflector plate 60 to be reflected to promote the atomization of the sprayed fuel. Then, a part of intake air upstream of the throttle valve 20 is inducted through the pipe members 70 and 68 and introduced into the pipe member 62. The introduced air is discharged through the openings 66 into the intake passageway 16, being guided by the air guide member 64 and the peripheral portion of the reflector plate 60. Accordingly, the small fuel particles reflected on the reflector plate 60 is effectively mixed with the air discharged from the pipe member 62 to form uniform air-fuel mixture. Furthermore, by virtue of such an arrange arrangement, the uniform distribution of the fuel particles to be adhered to the inner wall surface of the intake passageway 16 can be achieved, contributing to supplying air-fuel mixtures having the same air-fuel ratios into a plurality of the engine cylinders.

It is to be noted that, with the arrangement of FIG. 8, the distribution of the fuel injected from the fuel injector 38 can be improved particularly at the low load and low engine speed engine operating range. Because, at such an engine operating range, the opening degree of the throttle valve is considerably small and intake vacuum in the intake passageway downstream of the throttle valve 20 is considerably high and therefore the intake air amount inducted into the pipe member 62 increases to increase the air discharged from the pipe member 62 in pressure and in flow amount.

It will be understood that the reflector plate 60 may be provided with at least one opening passing through the wall of the plate 60 in place of the openings 66, in order to blow out air in the pipe member 62 into the intake passageway 16.

As appreciated from the foregoing discussion, according to the present invention, a fuel reflector disposed in the intake passageway between the throttle valve and the riser portion of the intake manifold and located opposite to the fuel injector nozzle in order to reflect at least a part of the sprayed fuel from the fuel injector. By virtue of the reflection of the injected fuel, the atomization of the injected fuel can be improved, and the uniformalization of the fuel to be adhered to the inner wall surface of the intake passageway is effectively improved, preventing that fuel stream flowing on the inner wall surface of the intake passageway. flows into particular branch runners of the intake manifold. Hence, supply of uniform air-fuel mixture into a plurality of the engine cylinders can be precisely achieved throughout various engine operating ranges including a full throttle engine operating range.

What is claimed is:

1. A fuel supply system for a multi-cylinder internal combustion engine, comprising:

means defining an intake passageway through which intake air is inducted into the engine cylinders of the engine, a part of said intake passageway being defined in a riser portion of an intake manifold, said intake passageway being provided therein with a throttle valve which is rotatable to control the amount of the intake air inducted into the engine cylinders and located upstream of said riser portion;

a fuel injector whose nozzle is located in said intake passageway;

a fuel reflector against which at least a part of the fuel injected from said fuel injector strikes to be reflected, said fuel reflector being located opposite to the tip of the nozzle of said fuel injector, said fuel reflector including a flat fuel reflector member having a body section which is secured to said intake passageway defining means so that at least a part of fuel injected from said fuel injector strikes against said flat fuel reflector member; and means for decreasing the size of fuel droplets which drop from the lower portion of said flat fuel reflector member toward said riser portion, said decreasing means including a sharp-pointed portion integral with said flat fuel reflector member which portion is located at the downstream side of the intake passageway relative to the body section of said flat fuel reflector member.

2. A fuel supply system for a multi-cylinder internal combustion engine, comprising:

means defining an intake passageway through which intake air is inducted into the engine cylinder of the engine, a part of said intake passageway being defined in a riser portion of an intake manifold, said intake passageway being provided therein with a throttle valve which is rotatable to control the amount of the intake air inducted into the engine cylinders and located upstream of said riser portion;

a fuel injector whose nozzle is located in said intake passageway;

a fuel reflector against which at least a part of the fuel injected from said fuel injector strikes to be reflected, said fuel reflector being located opposite to the tip of the nozzle of said fuel injector, said fuel reflector including a fuel reflector plate which is secured to said intake passageway defining means so that at least a part of fuel injected from said fuel injector strikes against said reflector plate; and means for decreasing the size of fuel droplets which drop from the lower portion of said fuel reflector plate toward said riser portion, said decreasing means including a sharp-pointed portion of said fuel reflector plate which portion is located at the downstream side of the intake passageway relative to the other portions of said reflector plate.

3. A fuel supply system as claimed in claim 2, in which said fuel reflector plate is such located that a part of the fuel injected from said fuel injector strikes against said sharp-pointed portion.

4. A fuel supply system as claimed in claim 2, in which said fuel reflector plate is formed at its central portion with an opening passing through the wall thereof, said reflector plate being such located that a part of the fuel injected from said fuel injector passes through said opening and the remaining fuel injected from said fuel injector strikes against the surface of said fuel reflector plate.

5. A fuel supply system as claimed in claim 2, in which said intake passageway defining means includes means defining a throttle chamber in which said throttle valve is disposed, means for defining a fuel injection chamber in which the nozzle of said fuel injector and said fuel reflector plate are located, said fuel injection chamber being directly communicating with said throttle chamber, and the intake manifold formed with the riser portion and a plurality of branch runners communicable with the engine cylinders, respectively, said riser portion being directly communicable with said fuel injection chamber, said intake passageway being constituted with said throttle chamber, said fuel injection chamber, said riser portion and said branch runners.

6. A fuel supply system as claimed in claim 5, in which said fuel reflector plate lies in a plane including the center axis of said fuel injection chamber.

* * * * *